United States Patent [19]

Nickerson

[11] 4,027,445

[45] June 7, 1977

[54] INSULATED BLOCK

[75] Inventor: David L. Nickerson, Wilbraham, Mass.

[73] Assignee: Korfil, Incorporated, Chicopee, Mass.

[22] Filed: Dec. 4, 1975

[21] Appl. No.: 637,641

[52] U.S. Cl. ..... 52/405; 52/309.2; 52/309.13

[51] Int. Cl.[2] ..... E04B 1/88; E04B 2/08

[58] Field of Search ..... 52/405, 421, 218

[56] References Cited

UNITED STATES PATENTS

| | | | |
|---|---|---|---|
| 2,852,934 | 9/1958 | Amundson | 52/405 |
| 3,581,777 | 1/1971 | Hodges et al. | 52/218 |
| 3,885,363 | 5/1975 | Whittey | 52/405 |

FOREIGN PATENTS OR APPLICATIONS

| | | | |
|---|---|---|---|
| 697,378 | 8/1963 | Canada | 52/405 |
| 1,181,369 | 1/1959 | France | 52/405 |

*Primary Examiner*—James L. Ridgill, Jr.
*Attorney, Agent, or Firm*—McCormick, Paulding & Huber

[57] ABSTRACT

A preformed masonry building block having a U-shaped preformed insulating insert of molded expandible polystyrene disposed in each cavity thereof. Each web of the building block is provided with a vertical insulating slot which is at least three fourths (¾) of an inch wide and which has a volume equal to at least one half (½) a volume found by multiplying slot width by web height and thickness. Each end web has a slot adjacent the end of each leg of the adjacent insert and the legs project into and fill the slots. The intermediate web has a slot on each side thereof adjacent the body portions of the inserts and a projection on the body portion of each insert enters and fills its adjacent slot.

6 Claims, 3 Drawing Figures

INSULATED BLOCK

BACKGROUND OF THE INVENTION

The insulation of masonry building blocks has taken a variety of forms. After a wall has been constructed or partially constructed of such blocks, insulation has been introduced in situ. Insulation has also been molded directly in the cavities of such blocks. Further, various special types of blocks have been provided with insulation mounted internally or secured externally. One form of block insulation, rapidly gaining in popularity, is disclosed in U.S. Pat. No. 3,885,363 to Richard W. Whittey entitled INSULATED BLOCK. As disclosed therein, preformed insulating inserts are introduced to the cavities of building blocks at the block plant after the blocks have been formed and the blocks may thereafter be handled during construction in the ordinary manner of uninsulated blocks. Obvious advantages in efficiency and convenience are thus achieved.

In the last mentioned insulating technique, however, as in substantially all of the methods employed, the building blocks have two or more transverse webs between inner and outer side sections and substantial heat transfer occurs conductively therethrough. To date, there has been no effective solution to this problem.

SUMMARY OF THE INVENTION

It is the general object of the present invention to provide an insulated masonry building block of the type which has one or more cavities containing a preformed insulating insert and which also includes transverse webs modified in such manner as substantially to reduce heat transfer thereacross.

DESCRIPTION OF THE PREFERRED EMBODIMENT

Directional and/or geometrical terms such as "top", "bottom", "side", "transverse", "horizontal", "vertical", etc. are used freely hereinbelow but it is to be understood that such terminology is employed for convenience of description only and is not to be regarded as in any way limiting the invention in the specification or the claims which follow.

Figure 1:
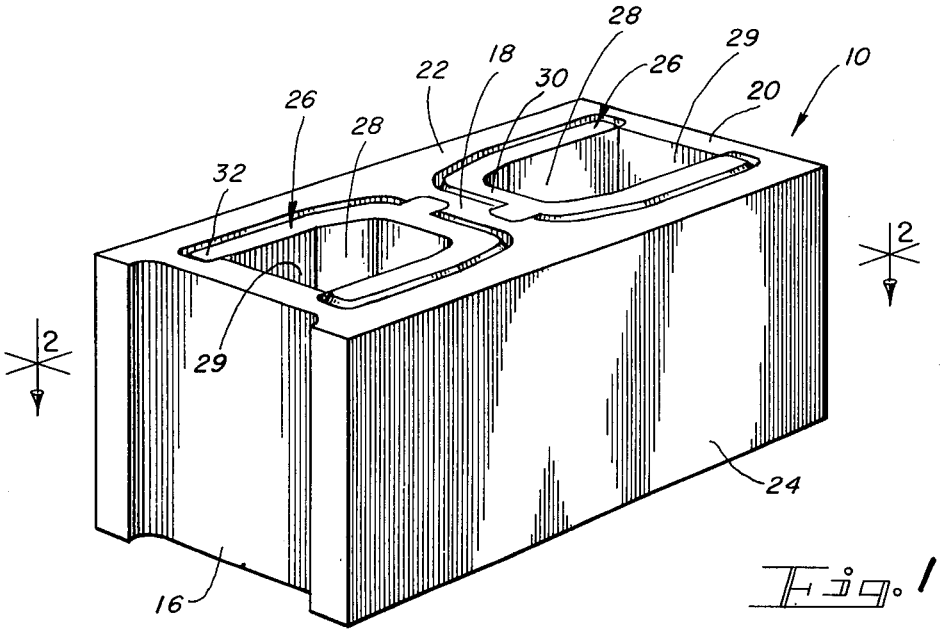
FIG. 1 is a perspective view of an improved insulated building block forming a first embodiment of the present invention.
Figure 2:
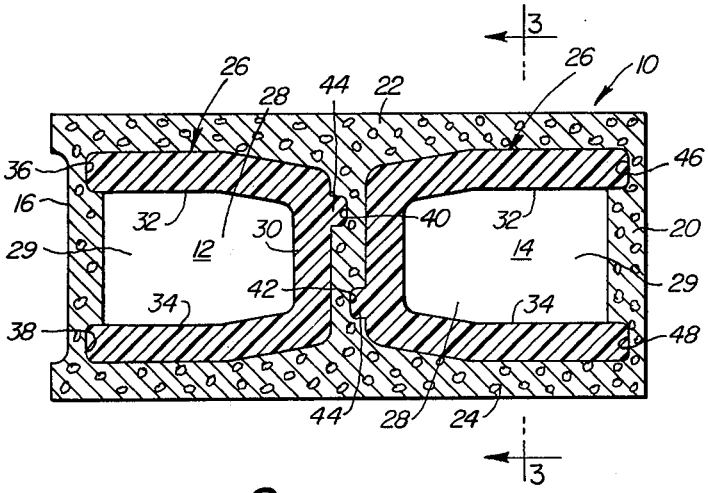
FIG. 2 is a horizontal section taken generally as indicated at 2—2 in FIG. 1 and showing the internal configuration of the block and its insulating inserts.
Figure 3:
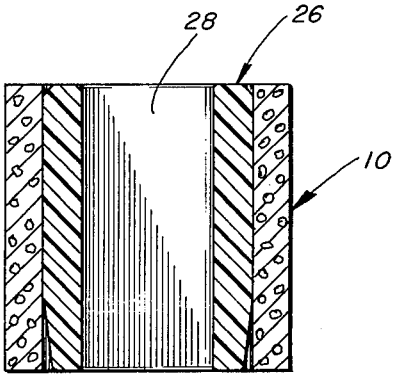
FIG. 3 is a vertical section taken generally as indicated at 3—3 and showing a portion of the block and an insert.

Referring particularly to FIGS. 1 through 3, it will be observed that an insulated building block indicated generally at 10 is of a conventional type. While the present invention contemplates conventional masonry building blocks, it is to be further understood that the invention is not limited to blocks of any particular configuration or material.

The building block 10 illustrated in FIGS. 1–3 is generally rectangular in form and includes first and second identical cavities or vertical through openings 12, 14. That is, the openings or cavities 12, 14 extend throughout the vertical dimension of the block and are bounded transversely by webs 16, 18 and 20. The transverse webs 16 and 20 are located approximately at end portions of the block and the web 18 is located approximately centrally or intermediate the length thereof. Opposite parallel side sections 22, 24 of the block extend longitudinally in transversely spaced relationship and are conventionally formed integrally with the webs 16, 18 and 20.

The building block 10 is preformed in a conventional manner and it will be apparent that the block can be readily lifted and manipulated by a mason or other workman grasping one of the webs thereof from above, finger access from above thus being essential. Similarly, finger access to the webs from below should be provided for when the blocks are handled in an attitude inverted from that shown, the latter attitude being conventional during construction while the former prevails during block manufacture.

The cavities 12 and 14 taper gradually inwardly and downwardly as shown and during block manufacture the cores employed in molding the blocks may of course vary somewhat in dimension, particularly as abrasive wear occurs on the outer surfaces thereof over long periods of use. Thus, the cross sectional configurations and/or dimensions of cavities such as 12, 14 are subject to variation over a substantial range. Such variation may occur from block to block and even from cavity to cavity within a single block.

First and second or left and right hand insulating inserts 26, 26 in FIGS. 1–3 are formed of a light weight foraminous heat insulating and fire retardant material. Thus a fire stop function and a substantial degree of resistance to sound and moisture transmission are also provided, molded expanded polystyrene presently comprising a preferred material. The inserts are preformed in a configuration such as to enter and substantially fit the cavities in the building blocks and a substantial cross sectional compressibility is provided for whereby a condition of slight compression exists when an insert is entered and secured in its cavity. Thus, the external surface of the insert is in firm engagement with the cavity walls irrespective of the dimensional variations as aforesaid and the inserts are frictionally retained within the cavities against accidental or unintended displacement during transport, etc.

A second important consideration in insert configuration resides in the provision of an insert wherein at least a part of one end portion adjacent a web is substantially removed or otherwise modified to provide for finger access to the web, lifting and manipulation of the building block thus being facilitated.

As described more fully in the aforesaid U.S. Pat. No. 3,885,363, at least one elongated vertical opening is provided in each insert and extends from top to bottom whereby to enhance the cross sectional compressibility of the insert. In each of the inserts 26, 26 illustrated, a relatively large and centrally located vertical through opening is provided at 28. Further, the required finger access to the end webs 16, 20 of the block is provided for by removal of an outer or end wall of each insert 26 at an area 29. More particularly, and as illustrated in FIGS. 1–3, the entire outer or end wall of each insert 26 at 29 is dispensed with from top to bottom and a U-shaped insert cross section results, each insert thus having a body portion 30 and first and second similar legs 32, 34 integral with the body portion. The "U" configuration for the inserts is found to be particularly desirable in the provision of both top and bottom finger access to the end webs 16, 20 and in a relatively high level of cross sectional compressibility resulting from both the provision of the central through openings 28, 28 and the removal of outer end walls, inwardly flexible legs 32, 34 thus being provided.

Building blocks equipped with the specific U-shaped insulating inserts shown and described above or with other inserts within the scope of the invention exhibit substantial reduction in thermal conductivity or heat transfer characteristics, commonly expressed in the industry as an improvement in "U Factor". It is known, however, that substantial heat transfer occurs through the transverse webs of the blocks, such as indicated at 16, 18, 20. Accordingly, the present invention contemplates the modification of such webs to substantially improve the desired heat transfer characteristics i.e. to improve or to lower the U Factor such that there is less heat loss through the building blocks comprising the walls of a heated building or, conversely, a lesser degree of heat transfer inwardly through the walls of an air conditioned building. The preferred manner in which web modification is accomplished involves the provision of slots in one or more of the transverse webs in a building block, the slots being filled with integral projections formed on adjacent insulating inserts.

The configurations and dimensions of the slots provided in the transverse webs may vary within the scope of the invention, but must represent a judicious compromise between insulating efficiency and maintenance of top to bottom compressive strength of the building blocks. It is presently preferred practice to provide a slot having a depth at least one fourth (¼) the thickness of the web in which it is formed and, more particularly, optimum slot depth is thought to be approximately one half (½) the thickness of the web. Thus, where a web thickness of approximately one inch is provided, as is conventional in many building block designs or configurations, a slot depth of approximately one half (½) inch is provided for. Similarly, the volume of the web slot should be at least one fourth (¼) of the volume found by multiplying web thickness times web height times the width at the mouth of the slot. With the slot depth of one half (½) web thickness, the slot volume is of course, one half (½) this volume. Slot width may also vary but should be at least three fourths (¾) of an inch, a three fourths (¾) inch insulated gap having thermal resistance characteristics equal to that of a much larger gap.

Reverting now to FIGS. 1–3, and with particular reference to FIG. 2, it will be observed that the transverse end web 16 is provided with a pair of similar vertical insulating slots 36, 38. The slots 36, 38 extend through approximately one half (½) the thickness of the web 16, from top to bottom thereof, and the width thereof may be regarded as approximately three fourths (¾) of an inch. Further, the slots are respectively adjacent and aligned with end portions of the legs 32, 34 of the left hand insulating insert 26 and, extensions or projections on the legs extend into and substantially fill the slots. That is, if the insert 26 is regarded as normally having legs extending to the interior surface or wall of the transverse web 16, the extreme end portions of the legs shown may be regarded as extensions or projections entering and filling the slots 36, 38.

The intermediate transverse web 18 in FIG. 2 is also provided with insulating slots and, preferably, a pair of transversely spaced slots are arranged as illustrated at 40, 42. That is, a first slot 40 is provided adjacent a body portion 30 of the left hand insert and a second slot 42 adjacent the body portion 30 of the right hand insert 26. The slots 40, 42 are or may be identical with the slots 36, 38 extending through one half (½) web thickness, from top to bottom of the web, and having a width of approximately three fourths (¾) of an inch. As will be obvious, the slots 40, 42 are offset transversely an equal distance from a longitudinal center line through the building block and this provides for identity and convenient molding of the inserts 26, 26 each with a projection 44 thereon. The projections 44, 44 on the inserts 26, 26 extend into and substantially fill the slots 40, 42 from the body portions 30, 30 of the inserts.

The right hand web 20 is provided with insulating slots 46, 48 in a manner identical with the provision of the insulating slots 36, 38 in the left hand end web 16. Further, projections on the ends of the legs 32, 34 of the right hand insert 26 respectively enter and fill the slots as in the case of the left hand insert.

With the presently preferred block and insert configuration of FIGS. 1–3, a substantial U-Factor improvement is achieved, and no significant loss in vertical compressive strength is encountered. The use of insulating inserts alone and without any form of web treatment is found to achieve a U-Factor improvement from approximately 0.3 to 0.2 or slightly below. With the web and insert modification illustrated in FIGS. 1–3 a further reduction from a U-Factor of approximately 0.2 to a U-Factor of approximately 0.13 to 0.15 is achieved, a substantial conservation of energy being thus realized.

From the foregoing, it will be apparent that the building block and insert assembly achieves substantial improvement in thermal resistance or insulating characteristics, due consideration is nevertheless given to the ease and convenience with which blocks can be lifted and manipulated during transport and on site construction, and manufacture of both blocks and inserts can be achieved at economic advantage. Still further, modification or slot treatment of the transverse webs of the building blocks is accomplished in such manner as not to effect significantly the top to bottom compressive strength thereof.

I claim:

1. The combination of a preformed building block of concrete and at least one preformed generally U-shaped open ended insulating insert therefor; said block having generally parallel and planar top and bottom surfaces with at least one top-to-bottom through cavity of generally rectangular cross section, said block also having opposite generally parallel side sections and at least two transverse webs of substantially uniform thickness extending between said side sections, integral at opposite ends with the side sections and defining said cavity in cooperation with said side sections, the said generally rectangular cross sectional configuration and dimensions of said cavity being subject to variation within a significant range during manufacture, said insert being of a light weight cellular heat insulating and fire retardant material and having an external configuration which is generally rectangular and adapted to enter said cavity in the block, the insert when so entered having its connecting portion extending along and engaging one of said webs, its opposite legs extending along and respectively engaging said opposite side sections of the block, and its open end and the end surfaces of its legs adjacent the opposite web, the insert thus being disposed with top and bottom surfaces of its legs and connecting portion adjacent and substantially parallel respectively with said block top and bottom surfaces and defining a second and somewhat smaller top-to-bottom through cavity within itself, and the dimension between said top and bottom insert surfaces being equal to or less than the corresponding dimension between the block top and bottom surfaces such that neither of said surfaces projects beyond the adjacent block top and bottom surface, and said insert being cross sectionally compressible with its legs slightly flexible transversely so as to accommodate said cross sectional variation in said block cavity and to provide for slight compression and firm engagement of insert external surfaces with the cavity wall and for secure frictional retention of the insert in the block cavity, said transverse block web adjacent said end surfaces of the insert and its open end having a pair of similar top-to-bottom through slots extending respectively adjacent said leg end surfaces, and said insert legs being sufficiently long and flexible respectively to enter said slots, said transverse block web adjacent said connecting web also having a top-to-bottom through slot, said insert having an integral external top-to-bottom extending projection on its said connecting portion entering said slot, and each of said slots having a depth at least one fourth (¼) the thickness of its web, so as to locally reduce the web thickness, a width at least three fourths (¾) of an inch, and a total volume equal to at least one fourth (¼) the volume found by multiplying web thickness times web height times the width at the mouth of the slot.

2. The combination comprising a preformed building block and insulating insert as set forth in claim 1 wherein said slots have a depth approximately one half (½) the thickness of the webs, and wherein total volume of each is equal to approximately one half (½) the volume found by multiplying web thickness times web height times the width at the mouth of the slot.

3. The combination comprising a preformed building block and insulating insert as set forth in claim 1 wherein 2 substantially identical cavities are formed in the building block, wherein 3 transverse webs of substantially uniform thickness are formed with one web intermediate the cavities and with the remaining two webs disposed respectively adjacent outer ends of the cavities, the said webs being thus located approximately at opposite ends of the block, and wherein a U-shaped insert is provided for each of said cavities.

4. The combination comprising a preformed building block and insulating insert as set forth in claim 3 wherein said webs are provided with slots as aforesaid, wherein said inserts are disposed in their respective cavities with their body portions adjacent said intermediate web and the ends of their legs adjacent said opposite end webs, said insert legs and integral projections entering and fitting said slots as aforesaid.

5. The combination comprising a preformed building block and insulating insert as set forth in claim 4 wherein said intermediate web slots respectively on opposite sides thereof are spaced transversely from each other, and wherein the insert integral projections respectively enter and substantially fill said slots, said inserts being identical but oppositely oriented in their cavities.

6. The combination as set forth in claim 5 wherein said inserts are of a molded expandible polystyrene.

* * * * *